US008371146B1

(12) United States Patent
McCarthy

(10) Patent No.: US 8,371,146 B1
(45) Date of Patent: Feb. 12, 2013

(54) TRACK FITTING GARAGE DOOR LOCK APPARATUS AND ASSOCIATED METHOD

(76) Inventor: Kenneth McCarthy, Elizabeth Town, PA (US)

( * ) Notice: Subject to any disclaimer, the term of this patent is extended or adjusted under 35 U.S.C. 154(b) by 322 days.

(21) Appl. No.: 12/835,152

(22) Filed: Jul. 13, 2010

Related U.S. Application Data

(60) Provisional application No. 61/279,881, filed on Oct. 27, 2009.

(51) Int. Cl.
*E05B 65/08* (2006.01)

(52) U.S. Cl. ..... 70/95; 70/34; 70/56; 49/197; 49/449

(58) Field of Classification Search ..... 70/14, 33, 70/34, 54–56, 94, 95, 99, 100; 49/197, 449
See application file for complete search history.

(56) References Cited

U.S. PATENT DOCUMENTS

| | | | | |
|---|---|---|---|---|
| 2,114,910 | A | 11/1936 | Shattuck | |
| 3,159,205 | A | 12/1964 | Varacalli | |
| 3,600,912 | A | 8/1971 | Foreman | |
| 3,788,678 | A | 1/1974 | Switzgable | |
| 4,345,448 | A | 8/1982 | Solomon | |
| 4,428,211 | A * | 1/1984 | Hermann | 70/34 |
| 4,570,467 | A | 2/1986 | Greco | |
| 4,829,887 | A * | 5/1989 | Holschbach | 454/56 |
| 4,937,979 | A * | 7/1990 | Liou | 49/449 |
| 4,968,072 | A | 11/1990 | Taylor et al. | |
| 5,022,243 | A * | 6/1991 | Embry et al. | 70/34 |
| 5,024,073 | A * | 6/1991 | Lloyd | 70/491 |
| 5,063,763 | A * | 11/1991 | Johnson | 70/58 |
| 5,269,161 | A * | 12/1993 | Stillwagon | 70/34 |
| 5,489,130 | A * | 2/1996 | Clark | 292/66 |
| 5,533,561 | A | 7/1996 | Forehand, IV | |
| 6,735,990 | B1 * | 5/2004 | Murray et al. | 70/58 |
| 7,047,774 | B1 * | 5/2006 | Gogel | 70/32 |
| 7,784,520 | B2 * | 8/2010 | Paulson | 160/201 |

* cited by examiner

*Primary Examiner* — Suzanne Barrett

(57) ABSTRACT

A track fitting garage door locking apparatus includes a male block with an internal housing and a key hole. A locking mechanism may be coupled to the internal housing and detachably coupled to the male block. A worm screw is coupled to the internal housing and passes through an opening of the guide track. A female block may be affixed to the guide track. The female block may include an axial bore aligned with the worm screw. A key may be removably interfitted within the key hole and thereby lock and unlock the lock mechanism such that rotational articulation of the male block causes simultaneous rotation of the male block, the internal housing and the worm screw. In this manner, the male block may be linearly reciprocated towards and away from the female block as the worm screw and the internal housing are simultaneously rotated in a corresponding direction.

13 Claims, 4 Drawing Sheets

TRACK FITTING GARAGE DOOR LOCK APPARATUS AND ASSOCIATED METHOD

CROSS REFERENCE TO RELATED APPLICATIONS

This application claims the benefit of U.S. Provisional Application No. 61/279,881, filed Oct. 27, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to garage door locks and, more particularly, to a track fitting garage door lock for preventing unauthorized entry into a user's garage.

2. Prior Art

The art of locking assemblies with guards to prevent unauthorized access to a locking pin by burglar tools, such as a cutting tool, or a chisel or a jimmy, has been well explored. Most of these assemblies employ a padlock where the shackle is shielded. Unfortunately there is no simple closure assembly which provides adequate protection against an unusually forceful and carefully planned attack on the locking assembly so as to disable or dismantle it. Typically, such locks include a mounting element secured to the sliding member with the mounting element having a bolt which is moved between an unlocked position and a locked position. Many locks are of complicated construction and thus were expensive to manufacture.

Additionally, some locks were difficult to manipulate between the locked and unlocked positions. The essential concern of a suitable locking system is one that will prevent unauthorized access by means of burglarizing tools. Accordingly, the lock must be provided with appropriate guard plates to avoid insertion of a chisel, tool, or the like, between various parts of the locking system, whereby the entire lock could be chiseled off the guide rail. Additionally the head portion of the lock should be appropriately protected to avoid the possibility of grasping the head of the lock and completely ripping the lock from the guide rail.

Accordingly, a need remains for an apparatus in order to overcome the above-noted shortcomings. The present invention satisfies such a need by providing a track fitting garage door lock that is convenient and easy to use, lightweight yet durable in design, versatile in its applications, and designed for providing a user with an effective means of preventing unauthorized entry into a garage.

BRIEF SUMMARY OF THE INVENTION

In view of the foregoing background, it is therefore an object of the present invention to provide an apparatus for preventing unauthorized displacement of a garage door employing a plurality of wheels rotatably interfitted along a guide track that is anchored to a support surface. These and other objects, features, and advantages of the invention are provided by a track fitting garage door lock.

The track fitting garage door locking apparatus may include a movable male block with an internal housing provided with a key hole axially formed therein. A locking mechanism may be coupled to the internal housing and detachably coupled to the male block. A worm screw may be statically coupled to the internal housing and may be adapted to pass through an opening of the guide track. A static female block may be adapted to be permanently and statically affixed to the guide track such that the female block is adapted to be maintained at a fixed position relative to the guide track. Such a structure may include a flange having a plurality of screw holes located at an outer boundary of the female block so that a plurality of fastening screws may be used to affix the female block to the guide track.

The female block may include an axial bore aligned with the worm screw. A key may be removably interfitted within the key hole and thereby actuate the locking mechanism to a locked position such that rotational movement of the male block causes simultaneous rotation of the internal housing and the worm screw. In this way, the male block may be linearly reciprocated towards and away from the female block as the male block, the worm screw and the internal housing are simultaneously rotated in a corresponding direction. Such an arrangement provides the unexpected and unpredictable advantage of providing a compact and rigid locking assembly for the guide track of a garage door. The arrangement further makes it difficult for a chiseling tool or the like to cut out a thinner or weak part of the locking assembly off the garage door track.

The apparatus may include a washer intermediately positioned between adjoining faces of the male and female blocks. The washer may further be adapted to be positioned at the garage door track opening and thereby maintained the male block spaced from the female block. In this way, the female block may remain spaced from the male block while the worm screw is interfitted within the axial bore of the female block. Such an arrangement provides the unexpected and unpredictable advantage of aligning the male and female blocks together as the washer may be used to offset any misalignment between the guide track and the male and female blocks. The washers may thus enable the worm screw to be better aligned with the axial bore of the female block to reduce the risk, for example, of distorting and even breaking the worm screw when there is a misalignment between the male and female blocks.

The locking mechanism and the internal housing may be located at a first end of the male block while the worm screw may be axially positioned through a second end of the male block such that the worm screw remains disposed exterior of the male block while the internal housing remains disposed interior of the male block. The male block may further include a first cavity and a second cavity in fluid communication with each other such that the internal housing may be rotatably seated inside the first cavity and prohibited from being axially displaced out from the first cavity. Such an arrangement provides the unexpected and unpredictable advantage of interfitting the male and female blocks together into a compact and rigid assembly thereby greatly reducing the risk of exposing a weak part of the apparatus that may be accessed and broken by an intruder.

The worm screw may axially pass through the second cavity and terminating within the female block such that the male block is maintained at a fixed spatial distance from the female block. The worm screw may further include a rectilinear shaft monolithically formed with the internal housing and a threaded distal end rotatably interfitted within the axial bore of the female block. Such an arrangement provides the unexpected and unpredictable advantage of using the worm screw to hold the male and female blocks in a locking arrangement instead of using conventional exposed lever locks which may be easily broken by an intruder.

The male block may be partially inserted into the female block when the worm screw is inserted into the axial bore of the female block such that the worm screw is entirely contained within the male and female blocks respectively. Such an arrangement provides the unexpected and unpredictable advantage of connecting the male and female blocks into a rigid and compact assembly so that the connecting element (worm screw) cannot be easily damaged by an unauthorized person to gain entry into the garage.

The present invention may further include a method of utilizing a track fitting garage door locking apparatus for preventing unauthorized displacement of a garage door employing a plurality of wheels rotatably interfitted along a guide track that is anchored to a support surface. Such a method may include the chronological steps of: providing a movable male block; providing an internal housing preferably having a key hole axially formed therein; providing and coupling a locking mechanism to the internal housing; detachably coupling the locking mechanism to the male block by providing and removably interfitting a key within the key hole and actuating the locking mechanism to an unlocked position; providing and statically coupling a worm screw to the internal housing; passing the worm screw through an opening of the guide track; providing a static female block including an axial bore; aligning the female block axial bore with the worm screw; and maintaining the female block at a fixed position relative to the guide track by permanently and statically affixing the female block to the guide track.

The method may further include the chronological steps of: simultaneously rotating the internal housing and the worm screw by rotatably articulating the male block in a same direction and thereby linearly reciprocating the male block towards and away from the female block. In this manner, when the locking mechanism is unlocked, the internal housing remains stationary as the male block is rotatably articulated so that an unauthorized person cannot detach the male block from female block.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
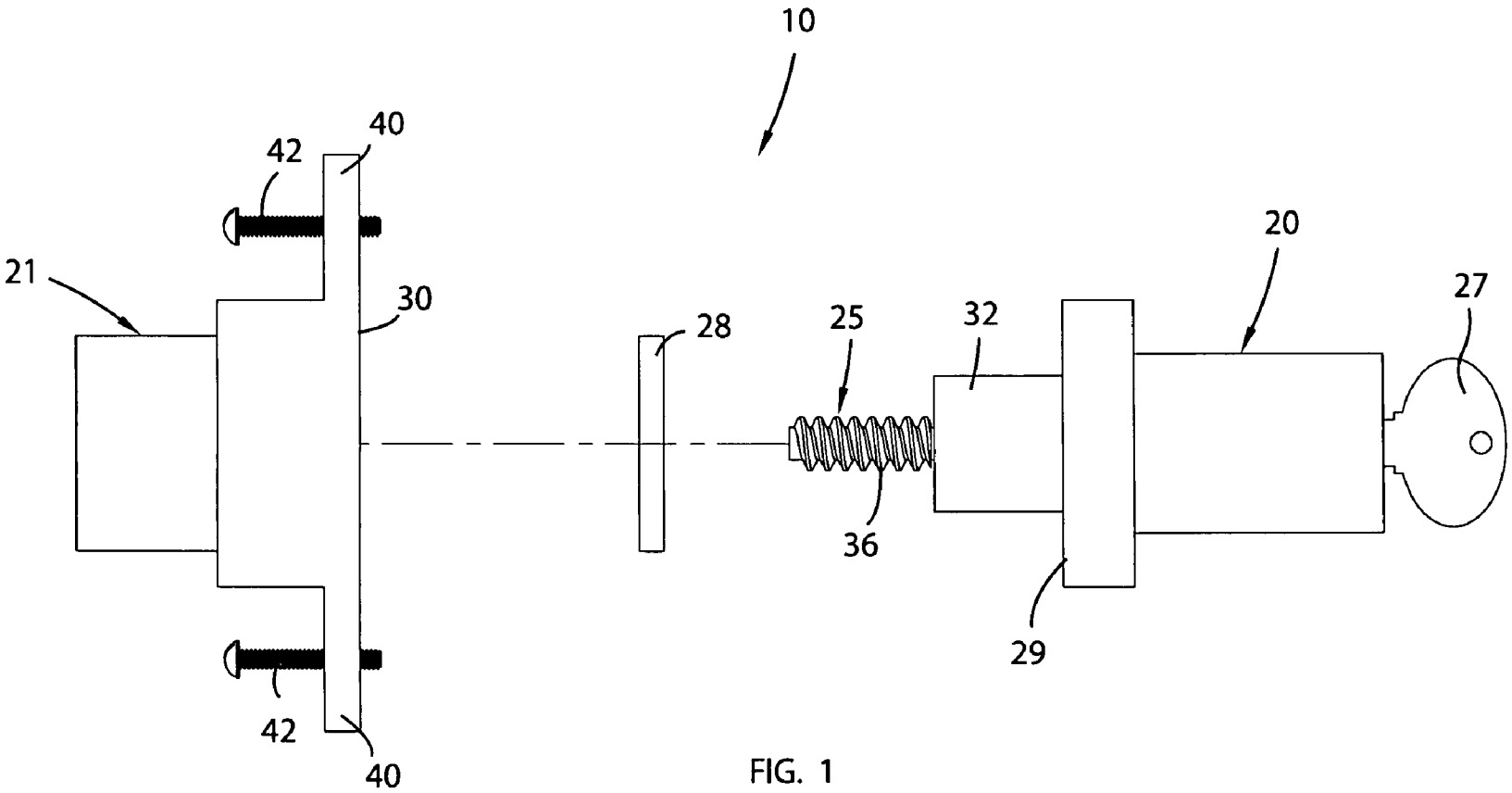
FIG. 1 is an exploded view showing the alignment of the washer between confronting faces of the male and female blocks, in accordance with the present invention.
Figure 2:
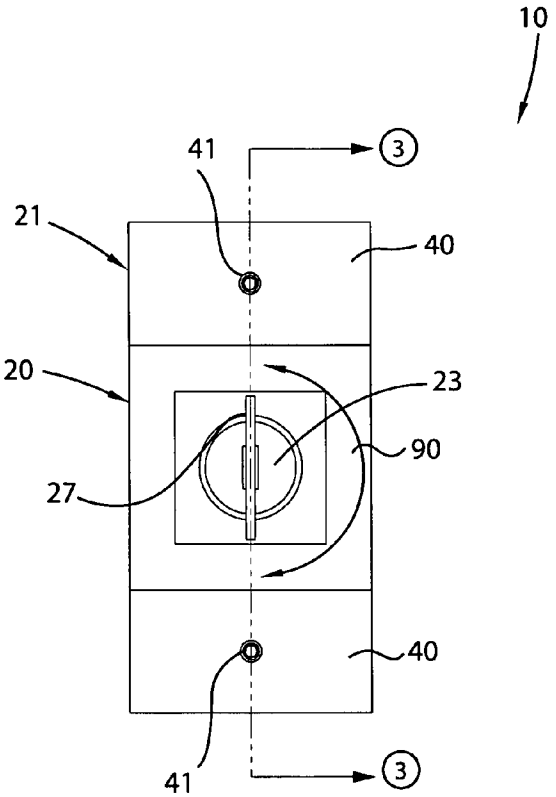
FIG. 2 is a front elevational view showing the position of the key into the male block.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The apparatus of this invention is referred to generally in FIGS. 1-4 by the reference numeral 10 and is intended to provide a track fitting garage door locking apparatus for preventing unauthorized displacement of a garage door. It should be understood that the track fitting garage door locking apparatus 10 may be used to prohibited unauthorized displacement of many different types of garage doors that employ rotatable wheels interfitted within a plurality of guide tracks anchored to a support surface, for example.

Referring generally to FIGS. 1-4, the track fitting garage door locking apparatus 10 may include a movable male block 20 having an internal housing 22 provided with a key hole 23 axially formed therein. A locking mechanism 24 may be coupled to the internal housing 22 and removably coupled to the male block 20. A worm screw 25 may be statically coupled to the internal housing 22 and may be adapted to pass through an opening 12 of the guide track 11. A static female block 21 may be adapted to be permanently and statically affixed to the guide track 11 such that the female block 21 is adapted to be maintained at a fixed position relative to the guide track 11. The female block 21 may include a flange 40 having a plurality of screw holes 41 located at an outer boundary thereof so that a plurality of fastening screws 42 may be used to affix the female block 21 to the guide track 11.

Figure 3:
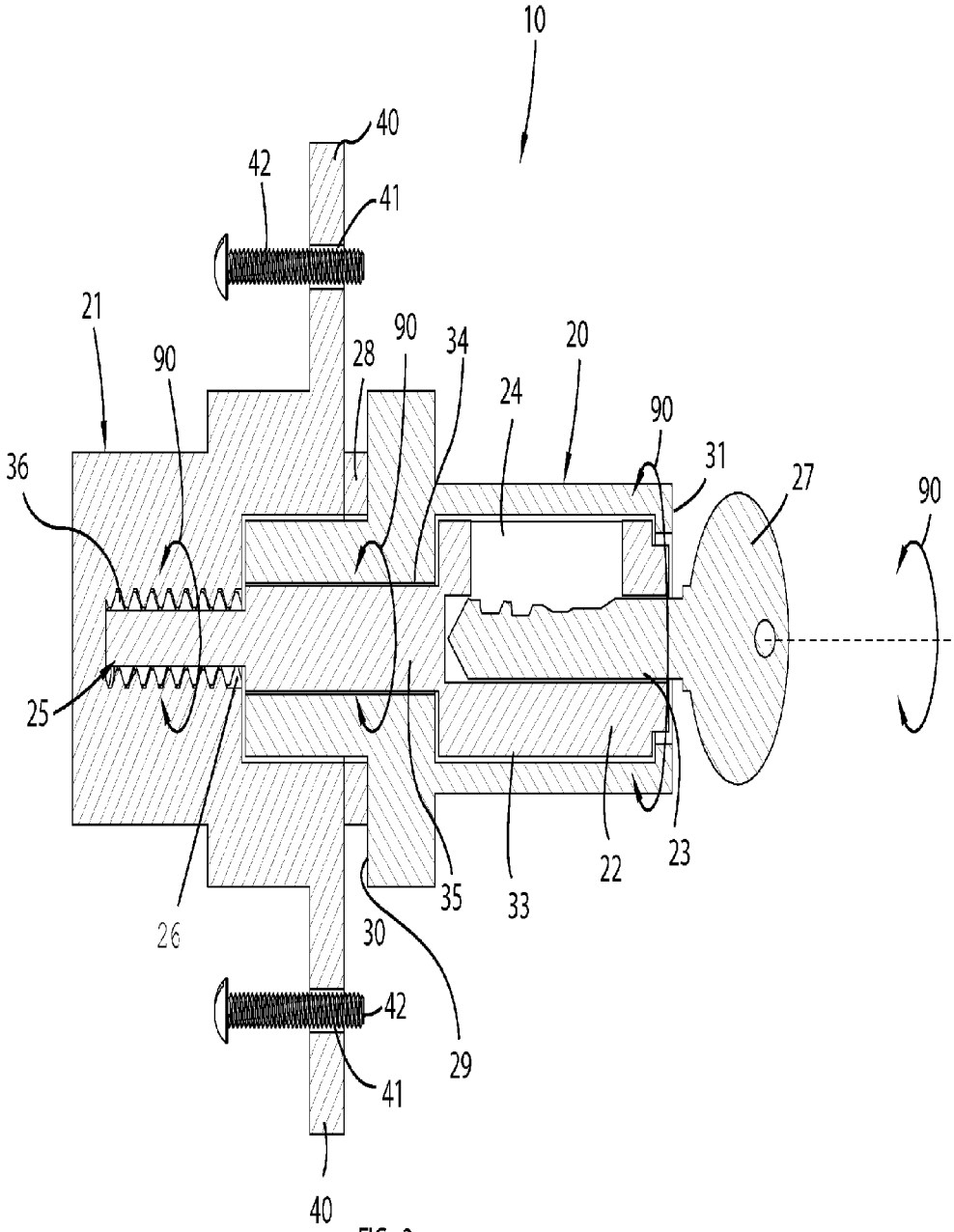
FIG. 3 is an enlarged cross-sectional view taken along line 2-2 in FIG. 2 showing the interrelationship between the male and female blocks, the key, the locking mechanism, the washer and the worm screw when the apparatus is at a locked position.
Figure 4:
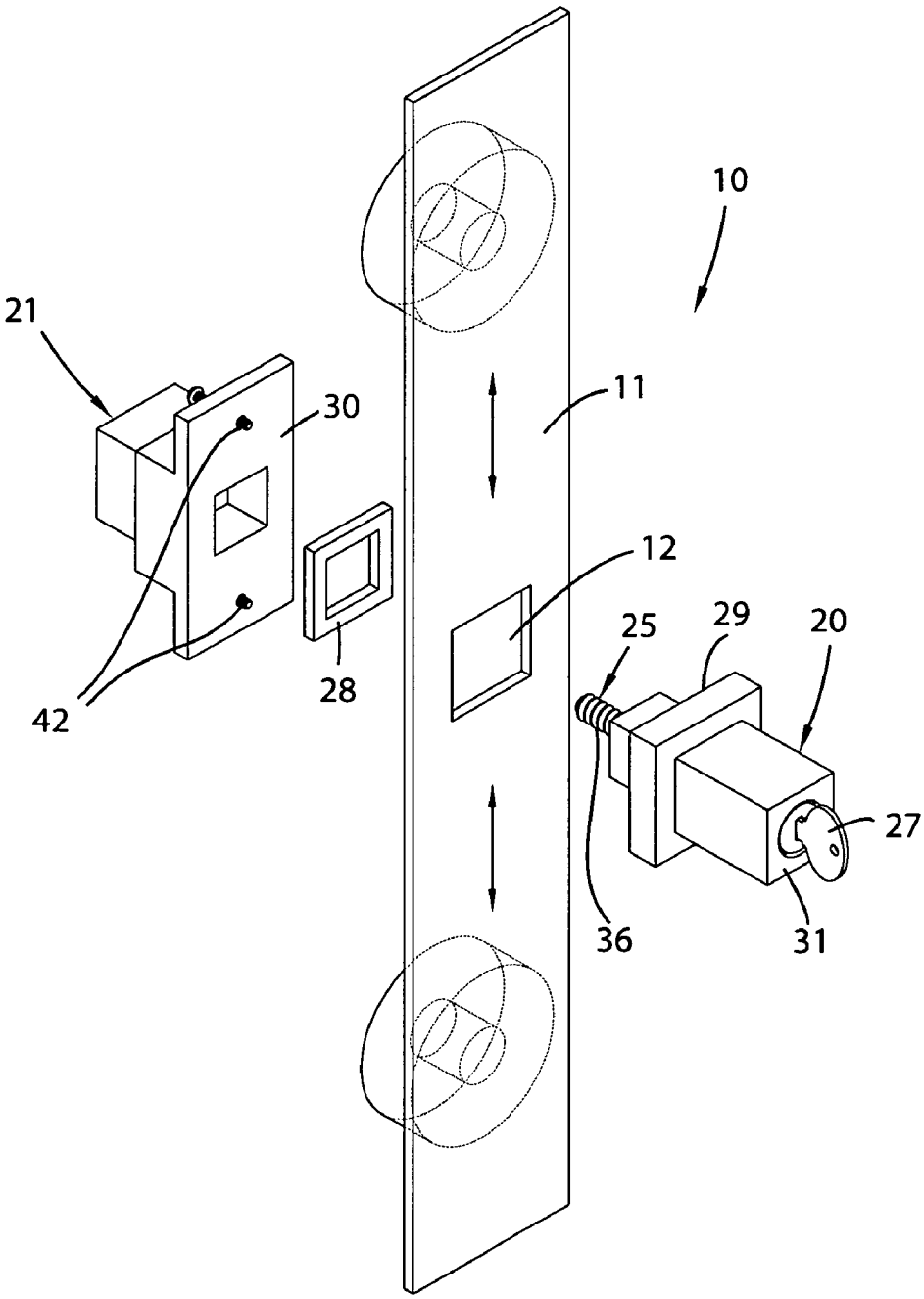
FIG. 4 is an exploded view showing placement of the garage door locking apparatus against a garage door track such that the garage door wheels are prohibited from traveling beyond a predetermined location.

The female block 21 may include an axial bore 26 aligned with the worm screw 25. Referring to FIG. 3, a key 27 may be removably interfitted within the key hole 23 and thereby actuate the locking mechanism 24 between locked and unlocked positions respectively. When locking mechanism 24 is adapted to a locked position, the male block 20 and internal housing 22 are locked together via locking mechanism 24. Such a locking mechanism 24 may include a conventional cam or tongue/groove type connection that is well known in the art. The type of locking mechanism 24 is not within the scope of this invention. One skilled in the art understands that various types of locking mechanisms 24 may be employed to selectively lock the internal housing 22 to male block 20. Such an arrangement provides the unexpected and unpredictable advantage of providing a compact and rigid locking assembly for the guide track 11 of a garage door. The arrangement makes it very difficult for a chiseling tool or the like to cut out a thinner or weak part of the locking assembly off the guide rail.

Locking the locking mechanism 24 permits a user to rotational articulate the male block 20 along clockwise and counter clockwise directions 90, as perhaps best shown in FIG. 3. Of course, key 27 may remain in the key slot 23, during articulation of male housing 20 while locking mechanism 24 is locked, if desired by the user. Notably, when male block 20 is articulated, the internal housing 22 also rotates simultaneously therewith. Such simultaneous rotation causes worm screw 25 to rotate as well and thereby linearly displace male block 20 towards or away from female block 21 depending on the direction of articulation. For example, the male block 20 may be linearly reciprocated towards and away from the female block 21 as the worm screw 25 and the internal housing 22 are simultaneously rotated in a corresponding direction. In this mode, the user is able to selectively detach and attach male block 20 to female block 21 for preventing unauthorized movement of the garage door.

Conversely, locking mechanism 24 may be adapted to an unlocked position by rotating key 27 in an opposite direction. The authorized user them removes key 27 from key slot 23. Unlocking the locking mechanism 24, disengages male block 20 from internal housing 22. As perhaps best shown in FIG. 3, internal housing 22 cannot be rotated independently of male block 20 nor linearly extracted from internal housing 22. Notably, rotational articulation of male block 20 fails to articulate internal housing 22 and worm screw 25 because locking mechanism 24 is unlocked and maintains male block 20 disengaged from internal housing 22. In this way, an unauthorized user cannot detach male block 20 from female block 20 and thereby push the garage door wheels beyond the location of the male block 20 at the garage door track.

Referring to FIGS. 1-4, the garage door locking apparatus 10 may include a washer 28 intermediately positioned between adjoining faces 29, 30 of the male and female blocks 20, 21. The washer 28 may be positioned at the garage door track opening 12 and thereby maintain the male block 20 spaced from the female block 21. In this way, the female block 21 may remain spaced from the male block 20 while the worm screw 25 is interfitted within the axial bore 26 of the female block 21. Such an arrangement provides the unexpected and unpredictable advantage of engaging the male and female blocks 20, 21 easily together as the washer 28 may be used to offset any misalignment between the guide track 11, worm screw 25 and axial bore 26. The washer 28 thus enables the worm screw 25 to be better aligned with the axial bore 26 of the female block 21 to reduce the risk, for example, of distorting and even breaking the worm screw 25 when male and female blocks 20, 21 are attached and detached.

As perhaps best shown in FIG. 3, locking mechanism 24 and internal housing 22 may be located at a first end 31 of the male block 20 while the worm screw 25 may be axially positioned through a second end 32 of the male block 20 such that worm screw 25 remains disposed exterior of the male block 20 while the internal housing 22 remains disposed interior of the male block 20. The male block 20 may further include a first cavity 33 and a second cavity 34 in fluid communication with each other such that the internal housing 22 may be rotatably seated inside the first cavity 33 (when locking mechanism 24 is unlocked) and prohibited from being axially displaced out from the first cavity 33. Such an arrangement provides the unexpected and unpredictable advantage of interfitting male and female blocks 20, 21 together into a compact and rigid assembly thereby eliminating the risk of exposing a weak part of the apparatus 10 that may be accessed and broken by an intruder.

Referring again to FIG. 3, the worm screw 25 may axially pass through the second cavity 34 and terminating within the female block 21 such that the male block 20 is maintained at a fixed spatial distance from the female block 21. The worm screw 25 may further include a rectilinear shaft 35 monolithically formed with the internal housing 22 and a threaded distal end 36 rotatably interfitted within the axial bore 26 of the female block 21. Such an arrangement provides the unexpected and unpredictable advantage of using the worm screw 25 to hold the male and female blocks 20, 21 in a secure locking arrangement instead of using conventionally exposed lever locks which may be easily broken by an intruder.

Again referring to FIG. 3, the male block 20 may be partially inserted into the female block 21 when worm screw 25 is inserted into the axial bore 26 of the female block 21 such that the worm screw 25 is entirely contained within the male and female blocks 20, 21 respectively. Such an arrangement again provides the unexpected and unpredictable advantage of connecting the male and female blocks 20, 21 into a rigid and compact assembly so that the connecting element (worm screw 25) is not damaged by an unauthorized person.

The present invention may include a method of utilizing a track fitting garage door locking apparatus 10 for preventing unauthorized displacement of a garage door employing a plurality of wheels rotatably interfitted along a guide track 11 that is anchored to a support surface. Such a method may include the chronological steps of: providing a movable male block 20; providing an internal housing 22 preferably having a key hole 23 axially formed therein; providing and coupling a locking mechanism 24 to the internal housing 22; removably coupling the locking mechanism 24 to the male block 20 by providing and removably interfitting a key 27 within the key hole 23 and actuating the locking mechanism 24 to a locked position.

Such a method may further include the chronological steps of: providing and statically coupling a worm screw 25 to the internal housing 22; passing the worm screw 25 through an opening of the guide track 11; providing a static female block 21 having an axial bore 26; aligning the female block 21 axial bore 26 with the worm screw 25; maintaining the female block 21 at a fixed position relative to the guide track 11 by permanently and statically affixing the female block 21 to the guide track 11.

Such a method may further include the chronological steps of: simultaneously rotating the internal housing 22 and the worm screw 25 by rotatably articulating the male block 20 in a same direction and thereby linearly reciprocating the male block 20 towards and away from the female block 21. In this manner, when the locking mechanism 24 is unlocked, the internal housing 22 remains stationary as the male block 20 is rotatably articulated so that an unauthorized person cannot detach the male block 20 from female block 21.

The male and female blocks 20, 21 may be manufactured of metal or any other such durable material obvious to one skilled in the art. The worm screw 25 may be long enough to pass through the openings of various garage door tracks 11. The washer 28 may be sized to be placed into the garage door track opening 12 which may have various shapes.

As an example, the track fitting garage door locking apparatus 10 would be simple and straightforward to use. First, the user may close the garage door. Next, the female block 21 may be secured to one side of the garage door track 11 adjacent to an opening 12 thereof. The male block 20 may be placed adjacent to opening 12 in the garage door track 11. The user may then insert the key 27 into key slot 23 and lock the locking mechanism 24. The worm screw 25 may then be passed through the track opening 12 by simultaneously rotating male block 20 and internal housing 22 (locking mechanism 24 is locked). The worm screw 25 may be inserted into the female block 21 axial bore 26. With the track fitting garage door locked in place the garage door would not be able to be opened because the door would be prevented from sliding along the garage door track 11.

In an alternative embodiment, the garage door locking apparatus 10 may feature a combination lock at the male block 20. This may eliminate the need for a key which can be easily lost. Once the correct combination is entered, locking mechanism 24 may be locked to the male block 20 and internal housing 22 along with worm screw 25 can be simultaneously unscrewed from the female block 21, thereby detaching male block 20 from female block 22 and allowing the garage door to be opened.

The combination of such claimed elements provides an unpredictable and unexpected benefit of using a compact yet strong locking assembly that is adapted to fit easily through the opening of a garage track guide, which solves the problem of allowing intruders to enter a home or facility by entering the garage.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A track fitting garage door locking apparatus for preventing unauthorized displacement of a garage door employing a plurality of wheels rotatably interfitted along a guide track that is anchored to a support surface, said track fitting garage door locking apparatus comprising:

a male block;

an internal housing provided with a key hole formed therein, said internal housing being disposed within said male block;

a locking mechanism coupled to said internal housing and detachably coupled to said male block;

a worm screw coupled to said internal housing, said worm screw being adapted to pass through an opening of the guide track;

a static female block adapted to be permanently and statically affixed to the guide track such that said female block is adapted to be maintained at a fixed position relative to the guide track, said female block including an axial bore aligned with said worm screw; and a key interfitted within said key hole and thereby actuating said locking mechanism to a locked position such that rotational articulation of said male block causes simultaneous rotation of said internal housing and said worm screw;

wherein said male block is reciprocated towards and away from said female block as said male block, said worm screw and said internal housing are simultaneously articulated in a corresponding direction;

wherein said male block is partially inserted into said female block when said worm screw is inserted into said axial bore of said female block such that said worm screw is entirely contained within said male and female blocks respectively.

2. The track fitting garage door locking apparatus of claim 1, further comprising: a washer intermediately positioned between adjoining faces of said male and female blocks, said washer adapted to be further positioned at the garage door track opening and thereby maintaining said male block spaced from said female block.

3. The track fitting garage door locking apparatus of claim 1, wherein said female block remains spaced from said male block while said worm screw is interfitted within said axial bore of said female block.

4. The track fitting garage door locking apparatus of claim 1, wherein said locking mechanism and said internal housing are located at a first end of said male block, said worm screw being axially positioned through a second end of said male block such that said worm screw remains disposed exterior of said male block while said internal housing remains disposed interior of said male block.

5. The track fitting garage door locking apparatus of claim 1, wherein said male block further comprises: a first cavity and a second cavity in fluid communication therewith, said internal housing being rotatably seated inside said first cavity and prohibited from being axially displaced out from said first cavity, said worm screw axially passing through said second cavity and terminating within said female block such that said male block is maintained at a fixed spatial distance from said female block.

6. The track fitting garage door locking apparatus of claim 1, wherein said worm screw comprises:

a rectilinear shaft monolithically formed with said internal housing; and a threaded distal end rotatably interfitted within said axial bore of said female block.

7. A track fitting garage door locking apparatus for preventing unauthorized displacement of a garage door employing a plurality of wheels rotatably interfitted along a guide track that is anchored to a support surface, said track fitting garage door locking apparatus comprising:

a movable male block;

an internal housing provided with a key hole axially formed therein, said internal housing being disposed within said male block;

a locking mechanism coupled to said internal housing and detachably coupled to said male block;

a worm screw statically coupled to said internal housing, said worm screw being adapted to pass through an opening of the guide track;

a static female block adapted to be permanently and statically affixed to the guide track such that said female block is adapted to be maintained at a fixed position relative to the guide track, said female block including an axial bore aligned with said worm screw; and a key removably interfitted within said key hole and thereby actuating said locking mechanism to a locked position such that rotational movement of said male block simultaneously rotates said internal housing and said worm screw;

wherein said male block is linearly reciprocated towards and away from said female block as said male block, said worm screw and said internal housing are simultaneously rotated in a corresponding direction;

wherein, when said locking mechanism is unlocked, said internal housing remains stationary as said male block is rotatably articulated;

wherein said male block is partially inserted into said female block when said worm screw is inserted into said axial bore of said female block such that said worm screw is entirely contained within said male and female blocks respectively.

8. The track fitting garage door locking apparatus of claim 7, further comprising: a washer intermediately positioned between adjoining faces of said male and female blocks, said washer adapted to be further positioned at the garage door track opening and thereby maintaining said male block spaced from said female block.

9. The track fitting garage door locking apparatus of claim 8, wherein said female block remains spaced from said male block while said worm screw is interfitted within said axial bore of said female block.

10. The track fitting garage door locking apparatus of claim 9, wherein said locking mechanism and said internal housing are located at a first end of said male block, said worm screw being axially positioned through a second end of said male block such that said worm screw remains disposed exterior of said male block while said internal housing remains disposed interior of said male block.

11. The track fitting garage door locking apparatus of claim 10, wherein said male block further comprises: a first cavity and a second cavity in fluid communication therewith, said internal housing being rotatably seated inside said first cavity and prohibited from being axially displaced out from said first cavity, said worm screw axially passing through said second cavity and terminating within said female block such that said male block is maintained at a fixed spatial distance from said female block.

12. The track fitting garage door locking apparatus of claim 11, wherein said worm screw comprises:

a rectilinear shaft monolithically formed with said internal housing; and a threaded distal end rotatably interfitted within said axial bore of said female block.

13. A method of utilizing a track fitting garage door locking apparatus for preventing unauthorized displacement of a garage door employing a plurality of wheels rotatably interfitted along a guide track that is anchored to a support surface, said method comprising the chronological steps of:

providing a movable male block;

providing an internal housing having a key hole axially formed therein;

disposing said internal housing within said male block;

providing and coupling a locking mechanism to said internal housing;

detachably coupling said locking mechanism to said male block by providing and removably interfitting a key within said key hole, and rotating said key such that said locking mechanism is selectively to a locked position;

providing and statically coupling a worm screw to said internal housing;

passing said worm screw through an opening of the guide track;

providing a static female block including an axial bore;

aligning said female block axial bore with said worm screw;

maintaining said female block at a fixed position relative to the guide track by permanently and statically affixing said female block to the guide track;

partially inserting said male block into said female block when said worm screw is inserted into said axial bore of said female block such that said worm screw is entirely contained within said male and female blocks respectively; and simultaneously rotating said internal housing and said worm screw by rotatably articulating said male block in a same direction and thereby linearly reciprocating said male block towards and away from said female block;

wherein, when said locking mechanism is unlocked, said internal housing remains stationary as said male block is rotatably articulated.

* * * * *